United States Patent [19]

Wolter

[11] 4,303,966

[45] Dec. 1, 1981

[54] LIGHT CONNECTABLE WITH A KEY

[76] Inventor: Heinz Wolter, Meiswinkel 3, 5067 Kürten, Fed. Rep. of Germany

[21] Appl. No.: 51,293

[22] Filed: Jun. 22, 1979

[30] Foreign Application Priority Data

Jun. 23, 1978 [DE] Fed. Rep. of Germany ..... 2827560

[51] Int. Cl.[3] ..... F21V 33/00

[52] U.S. Cl. ..... 362/116; 206/38; 150/40

[58] Field of Search ..... 362/116; 70/456 R; 206/37, 38, 234; 150/40

[56] References Cited

U.S. PATENT DOCUMENTS

| | | | |
|---|---|---|---|
| 1,972,879 | 9/1934 | Flintermann | 70/456 R |
| 2,593,030 | 4/1952 | Holmgren | 70/456 R |
| 2,789,613 | 4/1957 | Corsaw | 70/456 R |
| 2,964,937 | 12/1960 | Lautin | 70/456 R |
| 3,101,762 | 8/1963 | Bermingham | 150/40 |
| 3,310,668 | 3/1967 | Schwartz | 362/116 |
| 3,362,200 | 1/1968 | Lanier | 70/456 R |
| 4,085,315 | 4/1978 | Wolter | 362/116 |

FOREIGN PATENT DOCUMENTS

| | | | |
|---|---|---|---|
| 21954 | 3/1935 | Australia | 362/116 |
| 1196537 | 6/1965 | Fed. Rep. of Germany | 70/456 R |

*Primary Examiner*—Stephen C. Bentley
*Assistant Examiner*—Edward F. Miles
*Attorney, Agent, or Firm*—Martin A. Farber

[57] ABSTRACT

A light connectable with a key, which light comprises a housing receiving the bulb and battery with which the holding of the key is achieved by a wide surface side fastening of the key handle. The light housing is formed with a shaft and the key handle is able to be pushed into the shaft of the light housing.

10 Claims, 7 Drawing Figures

FIG. 1
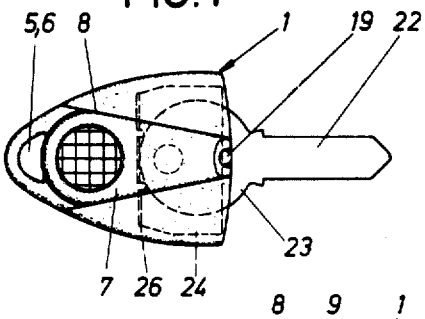
FIG. 2
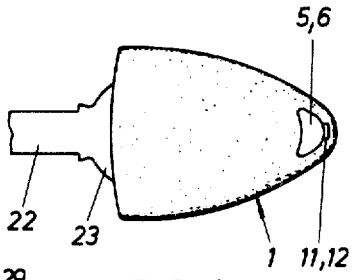
FIG. 3
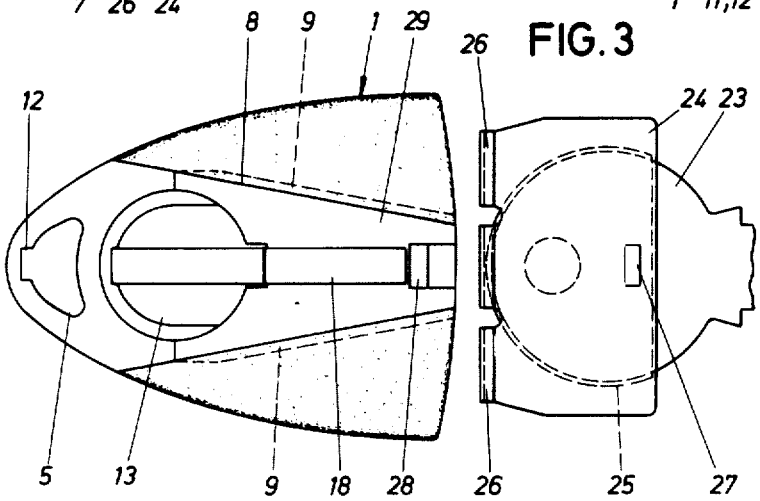
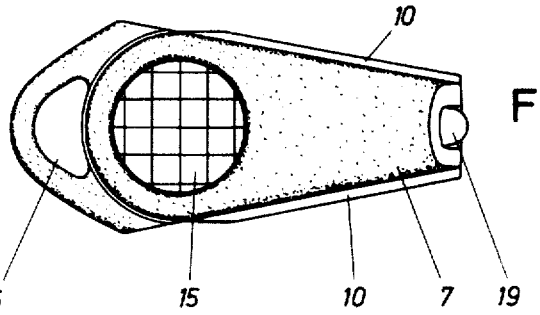
FIG. 4

LIGHT CONNECTABLE WITH A KEY

The invention relates to a light connectable with a key, which light has a housing receiving the incandescent bulb and battery and with which the holding or mounting of the key is achieved by a wide-surface-sided fastening of the key handle.

It is known by German Pat. No. 2 528 498 (corresponding to my U.S. Pat. No. 4,085,315) to brace the handle of the key against a self-adhesive layer of the light housing by means of a screw passing through the hole of the key handle. The tightening screw must be released also in case a change of the battery is required.

The subject matter of the invention is based on the task to form a light firmly connectable with a key of the introductory mentioned type in a simple manner of production technique which is more advantageous in use, such that screw connections are done away with and the insertion and exchange, respectively, of the battery can be performed more simply.

This task is solved by the invention in the manner that the key handle is positioned and connected flatly on a plate preferably by an adhesive layer, the plate together with the key being insertable into a shaft of the light housing, the thickness of the shaft corresponding substantially to the combined thickness of the plate plus the key handle.

As a consequence of such formation, a light of the introductory mentioned type, connectable with a key, of increased service value is provided. The plate fastened to the key handle is pushed-in or inserted in the shaft and consequently is held there. However, the forces of use do not need to be assumed or taken up by the adhesive, since the walls of the shaft provide the support. The key handle then is connected with the plate before the insertion into the light housing. Preferably this can also be brought about by means of a self-adhesive layer. The key subsequently is pushed-in or inserted positively or form-fittingly into the shaft (2) of the light housing with its key handle and the plate which is connected with the key handle. There the plate interlocks, so that as a consequence the key also is fixed with respect to the light housing. Instead of the interlocking also a fixing by means of a pin or the like could take place. Consequently a setting or fastening screw can be dispensed with. A possible battery change accordingly is not impaired or affected by such a fastening screw. Also the possibility exists of soldering the key handle with the plate, so that in this manner a very stable connection between the light housing and the key may be achieved.

An advantageous feature is to be seen in that the interlocking is achieved by at least one projection of the plate, which projection (e.g. 27) resiliently snaps into an opening (28) of the light-housing wall (29). The snapping-in of the projection occurs however only with a completely inserted plate. In this manner sufficient stability is guaranteed after the interlocking. The resiliency or spring action can also result from the elasticity of the shaft walls.

Furthermore, it proves favorable that the end edge (26) of the plate abuts against the rear wall of the light housing in the pushed-in position. Consequently the plate is secured against displacement in both directions.

A wobble-free holding or mounting of the plate is achieved in the manner that the plate end edge (26) is formed as a bent-off, resilient ledge. With a pushed-in key consequently the edge of the plate margin is constantly stressed or resiliently pressed.

With respect to the battery insertion and replacement, respectively, advantages reside in that the light housing continues beyond the rear wall of the shaft and in the area of this section, which section tapers toward the free end, has the reception recess or cavity (13) for the battery and light switch button, which battery and light switch button are engaged over by a housing cover, the cover forming a channel (20) extending up to the mouth of the shaft (2), the incandescent bulb being held positively or complementarily in the front end section of the channel.

Finally it is also of advantage to provide a dove-tail mounting and interlocking in the area of the bottom edge of the cover. This interlocking can be released in order to be able to insert or exchange the battery; after that the housing cover may be removed and a battery inserted into the housing cover.

One embodiment of the invention is explained on the basis of FIGS. 1-7.

FIG. 1 shows a view towards the light connectable with a key,

FIG. 2 shows the rear view of the light,

Figure 5:
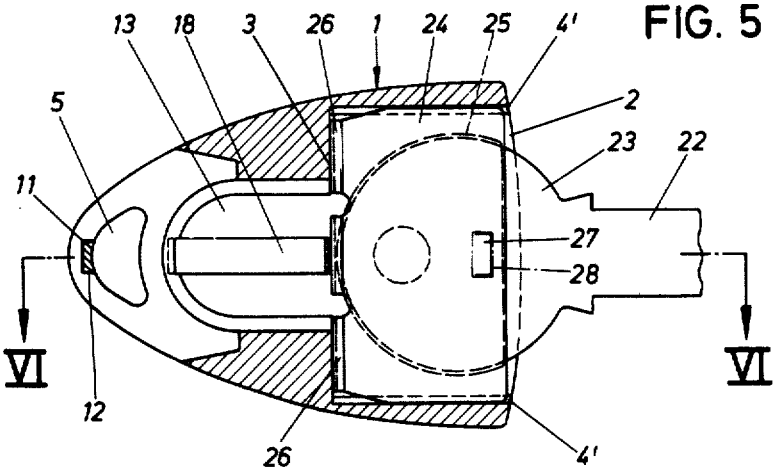
Figure 6:
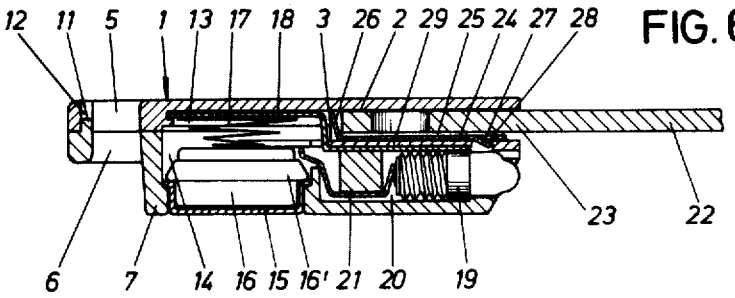
Figure 7:
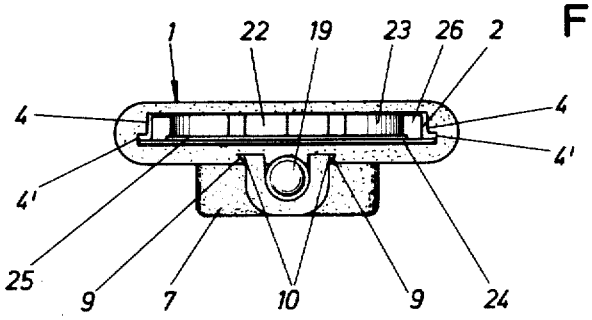

FIG. 3 in enlarged scale shows a view of the light housing with omitted housing cover before the insertion of the plate which is connected with the key handle, FIG. 4 shows a view of the housing cover, FIG. 5 shows a longitudinal section through the housing in the area of its shaft, FIG. 6 shows a view according to the lines IV–VI in FIG. 5 and, FIG. 7 shows the view towards the light seen from the tip of the key.

The light possesses the light housing 1, the light housing being made of an appropriate or suitable synthetic material or plastic. The light housing has the shape of approximately an isosceles triangle with curved or bowed sides of the triangle. The shaft 2 starts from the shorter side of the triangle, the shaft forming the rear wall 3. The side walls 4 of the shaft are recessed or set-off step-like, so that the shaft 2 widens toward one side.

The end of the light housing, which end is opposite to the shaft 2, forms an opening 5. The latter is flush in alignment with the opening 6 of the housing cover 7, the housing cover being insertable into a wedge-shaped groove 8 of the light housing 1. By means of a dove-tail mounting the housing cover 7 is prevented from being removed or lifted off. The dove-tail mounting is formed by undercut or back-tapered guides 9 of the light housing 1, in which guides there engages the cross-sectionally adjusted or complementary lateral edges 10 of the cover edge. The mounted housing cover 7 is prevented from being displaced or disaligned by means of a detent projection 11 which engages in a catch or notch opening 12, the opening 12 originating from the opening 5 of the housing 1.

On the other side of the rear wall 3 of the shaft 2 the reception recess 13 extends in the area of the tapering section, the recess 14 in the housing cover 7 being opposite the reception recess flush in alignment. The recess 14 is closed by the light-switch button 15, against which button the battery 16 is supported, the battery being formed as a button cell battery. A conically shaped compression spring 17 presses the button-cell battery 16 in the outward direction so that the light switch button engages an overlapping shoulder of the housing cover 7, the compression spring 17 being located in the reception recess 13 of the light housing 1. The compression spring 17 is in conducting connection with the contact rail 18, which contact rail leads to the incandescent bulb 19. The incandescent bulb is held lying positively without slipping or complementarily in the front end area in a channel 20 of the housing cover 7. In the channel 20 there extends a further contact bridge 21, the latter being in contact with the incandescent bulb 19, which contact bride 21, upon inward pressing or pushing-in of the light switch button 15 and thereby simultaneous displacement of the button cell battery 16, strikes against its edge 16', whereby the current circuit which leads to the incandescent bulb is closed.

The key 22 which is to be connected with the light housing 1 has a key handle 23. The wide surface of the handle 23 is fastened or attached to a plate 24 with a self-adhesive layer 25 positioned and therebetween. The size of the plate 24 corresponds to that of the largest width of the shaft 2, which width is formed by the step 4'. The end edge of the plate 24 which is adjacent to the rear wall 3 is formed as a bent-off resilient ledge 26. Then a free cut, bent-out resilient tongue 27 extends from the plate 24, which tongue 27 snaps into an opening 28 of the light-housing wall 29. The tongue 27 of the plate 24 can engage in this opening 28 of the housing wall 29 only if the plate is completely pushed-in or inserted into the step 4' of the shaft 2 of the housing 1. In the pushed-in position of the plate, the ledge 26 is pressed against the rear wall 3 of the shaft and stands under spring action, so that there is provided a stable encasement of the plate with the key handle in the shaft.

An exchange or replacement of the key 22 can be undertaken only after removal of the housing cover 7. The opening 28 in the housing wall 29 then is free so that the tongue 27 of the plate 24 can be displaced or moved in the inward direction, thereby leaving the area of the opening 28 and permitting the subsequent withdrawal of the key 22 with the plate 24. The removed housing cover 7 in the simplest manner also permits a battery replacement or change, since no screw connections exist.

The step 4' of the side walls 4 thereby allows the insertion or pushing-in of the plate only in one position, so that an interlocking of the tongue 27 with the opening 28 of the housing wall 29 is always guaranteed.

I claim

1. A light operating with an incandescent bulb and a battery and adapted to hold a key with a key handle, comprising a light housing being formed with means for cooperatively receiving the incandescent bulb and the battery, a plate, a wide surface of the key handle being fastened planarly on said plate, said light housing being formed with shaft means for receiving therein said plate with the key handle fastened thereon pushed into said shaft means of the light housing, said shaft means has an opening thickness corresponding to the combined thickness of said plate plus said key handle, said plate conforming in width to that of said shaft means so that the plate can be pushed complementarily in width into the shaft means, means for interlocking said plate with the housing in the pushed-in position, said interlocking means comprises, said light housing having a wall formed with an opening, and said plate formed with at least one projection means for the interlocking of said plate with the housing, said projection means snaps resiliently into said opening of said wall of said light housing in the pushed-in position.

2. The light according to claim 1, wherein said projection means is a tongue freely cut-out from said plate.

3. The light according to claim 2, wherein said light housing forms a rear wall of said shaft means of said light housing, said plate has an edge abutting against said rear wall of the shaft means of said light housing in the pushed-in position.

4. The light according to claim 3, wherein said edge is a ledge formed as a bent-off, resilient edge at en end of the plate biasing said tongue non-releaseably lockingly in said opening in the pushed-in position.

5. The light according to the claim 3, wherein said light housing extends beyond said rear wall of said shaft means into a rear section tapering toward a free end, a light switch button adapted to be disposed over the battery, said rear section is formed with a reception recess, said reception recess is said means for receiving the battery as well as the light switch button, a housing cover is releasably connected to said light housing and engages over the battery and light switch button, said housing cover forms a channel aligned in a central longitudinal plane of said light housing extending up to a mouth of said shaft means and laterally adjacent to said shaft means, said channel in cooperation with said light housing is said means for receiving the incandescent bulb, said incandescent bulb is held in a substantially complementarily shaped front end area of the channel.

6. The light as set forth in claim 4, wherein said plate has a flat side on which said key handle is fastened and a contour of said flat side larger than the contour of said key handle, said key handle being fastened completely within the confines of the contour of said flat side, said contour of said flat side of said plate is equal to a corresponding contour of said shaft means such that said plate is completely inserted in said shaft means in said pushed-in position and is non-twistably held therein in said pushed-in position.

7. The light as set forth in claim 6, wherein said shaft means is formed with a widened step portion, said plate is inserted into said step portion of said shaft means, said step portion is a widest portion of said shaft means.

8. The light as set forth in claim 6, further comprising a housing cover releaseably snappingly engaging said light housing and covering said opening of said wall of said light housing, said housing cover forms a channel laterally adjacent said shaft means, said channel in cooperation with said light housing is said means for receiving the incandescent bulb, said channel has a front open end adjacent a corresponding front open end of said shaft means, said incandescent bulb is disposed in the front open end of said channel, whereby said tongue can be removed by being pushed inwardly out of said opening to release said interlocking means from interlocking said plate with said light housing when said housing cover is removed from said light housing.

9. The light as set forth in claim 1, wherein said plate is adhesively connected to said key handle.

10. A light having an incandescent bulb and a battery and adapted to hold a key, comprising a light housing being formed with means for operatively receiving the incandescent bulb and the battery therein, means for holding the key in the housing by fastening of the key handle on a wide surface thereof, said light housing being formed with shaft means for the key handle to be pushed into said shaft means of the light housing, a plate, a wide surface of the key handle being fastened on said plate constituting the holding means, said plate conforming to said shaft means so that the plate can be pushed-in complementarily into the shaft means, means for interlocking said plate with the housing in the pushed-in position, said light housing forms a rear wall of said shaft means of said light housing, said plate has an edge abutting against said rear wall of the shaft means of said light housing in the pushed-in position, said light housing extends beyond said rear wall of said shaft means into a rear section tapering toward a free end, a light switch button adapted to be disposed over the battery, said rear section is formed with a reception recess, said reception recess is said means for receiving the battery and the light switch button, a housing cover engages over the battery and light switch button, said housing cover forms a channel extending up to a mouth of said shaft means, said channel is said means for receiving the incandescent bulb, said incandescent bulb is held in a substantially complementarily shaped front end area of the channel, said cover in a bottom area of an edge of the cover has lateral dove-tail edges, said light housing has dove-tail guides engaging with said dove-tail edges of said cover.

* * * * *